US012286740B2

(12) United States Patent
Albert Revert et al.

(10) Patent No.: US 12,286,740 B2
(45) Date of Patent: Apr. 29, 2025

(54) METHOD AND APPARATUS FOR TREATING A TEXTILE FABRIC

(71) Applicant: JEANOLOGIA, S. L., Paterna (ES)

(72) Inventors: Vicente Albert Revert, Paterna (ES); Victoria Puchol Estors, Paterna (ES); Vicente Fuster Fuster, Paterna (ES)

(73) Assignee: JEANOLOGIA, S. L., Paterna (ES)

( * ) Notice: Subject to any disclaimer, the term of this patent is extended or adjusted under 35 U.S.C. 154(b) by 918 days.

(21) Appl. No.: 17/358,514

(22) Filed: Jun. 25, 2021

(65) Prior Publication Data

US 2022/0002928 A1 Jan. 6, 2022

(30) Foreign Application Priority Data

Jul. 1, 2020 (EP) ..... 20382591

(51) Int. Cl.

| | |
|---|---|
| ***D06B 5/22*** | (2006.01) |
| ***D06B 1/14*** | (2006.01) |
| ***D06B 23/20*** | (2006.01) |
| ***D06L 4/13*** | (2017.01) |

(52) U.S. Cl.

CPC ..... *D06B 5/22* (2013.01); *D06B 1/14* (2013.01); *D06B 23/20* (2013.01); *D06L 4/13* (2017.01); *D06B 2700/35* (2013.01)

(58) Field of Classification Search

CPC ..... D06L 4/10; D06L 4/13; D06L 4/50

See application file for complete search history.

(56) References Cited

U.S. PATENT DOCUMENTS 2,803,517 A * 8/1957 White ..... D06L 4/70 8/111
3,377,131 A * 4/1968 Cerana ..... D06L 4/10 8/111
3,774,419 A * 11/1973 Appenzeller ..... D06B 3/206 68/175

(Continued)

FOREIGN PATENT DOCUMENTS

CN 111778657 A * 10/2020
JP H07-207572 A 8/1995

OTHER PUBLICATIONS

Machine translation of CN 111778657 A to Chen. (Year: 2020).*
European Search Report issued on Jan. 11, 2021 in corresponding European application No. 20 38 2591; 8 pages.

*Primary Examiner* — Joseph L. Perrin
(74) *Attorney, Agent, or Firm* — Maier & Maier, PLLC

(57) ABSTRACT

A method and an apparatus for desizing and/or shrinking a textile fabric, the textile fabric having a length and a width, the method including moving, lengthwise, the fabric, and wetting the fabric within a first pool of liquid, the first pool of liquid including water; passing the fabric through a chamber, and in the chamber contacting the fabric with at least one heatable roller heated at a treatment temperature; soaking the fabric with a main pool of liquid, the main pool of liquid including water; and treating the fabric with ozone. The apparatus includes a first module for wetting the fabric, a second module with a heatable roller for heating the fabric, a third module for soaking the fabric, and fourth module for treating the fabric with ozone. The second module may optionally be integrated with the first module.

9 Claims, 4 Drawing Sheets

(56) References Cited

U.S. PATENT DOCUMENTS

| | | | | |
|---|---|---|---|---|
| 5,261,925 | A * | 11/1993 | Wasinger | D06B 11/0096 8/102 |
| 2014/0068871 | A1 * | 3/2014 | Youn | D06P 5/132 8/111 |

* cited by examiner

METHOD AND APPARATUS FOR TREATING A TEXTILE FABRIC

TECHNICAL FIELD

The present invention relates to the technical field of methods and apparatuses for desizing and/or shrinking (preshrinking) textile fabrics.

BACKGROUND

In the textile industry, desizing, meaning the process of removing size material from yarns, particularly from warp yarns, after the textile fabric is woven, is a very important process. Likewise, shrinking of the textile fabric is a very important process in the textile processing and preparation; it is generally preferred that a shrinkage of the fabric happens in a controlled way during the processing and preparation of the fabric, rather during the subsequent use and handling of the fabric and any products containing it. For example, in the denim industry achieving a maximum or high shrinkage during preparation of a denim fabric is important because the fabric will later undergo various processing steps related to garment preparation. It is of interest to prepare a garment with the fabric being as close as possible to its final dimensions, so that when the end consumer buys a garment of a specific size, said size will not change (shrink) significantly and will not end up being too small. Therefore, shrinking, which is also called preshrinking, is a very important process in the textile industry.

Both desizing and shrinking (preshrinking) relate to potential changes happening on the surface of the fibers or yarns during the processing of the textile fabrics. Consequently, each of the desizing and shrinking may be correlated to changes of the fabric's appearance, color, degree of whiteness, ability to absorb dyes and/or be colored and/or be bleached, etc. Likewise, since several of the techniques used for altering a fabric's appearance, such as dyeing the fabric, comprise washing and/or wet processing steps during which uncontrolled shrinking may occur, it is of interest to apply controlled shrinking before or during or in between said techniques. For example, often it is desired to apply a shrinking (preshrinking) of a white fabric to be dyed, because the dyeing process can be improved as a result of said shrinking. Likewise, desizing occasionally, but not always, is accompanied by or causes bleaching of the fabric, and therefore a process used for desizing the fabric may also serve for intentionally bleaching (whitening) the fabric.

According to the above, a fabric preparation typically includes removing size material from the fabric (desizing), removing the husk or shell (deburring or scouring) of the cotton yarn or fiber, and/or making the fabric white (bleaching or whitening). In the prior art desizing and shrinking are typically performed using wet processing by means of large amounts of water and chemicals, and therefore are usually carried out in washing lines typically composed of between 6 and 8 washing boxes using large amounts of water (typically 12 $m^3$/h, approx. 250 L/m of fabric) and chemicals. The use of large amounts of solvents, water and chemicals for desizing and/or shrinking fabrics is problematic because it entails a big financial cost and a negative impact to the environment. The present invention offers a solution to the problem of how to perform desizing and/or shrinking of the fabrics in a more environmentally friendly and cost effective way without using excessive amounts of solvents, water and liquid or solid chemicals.

SUMMARY

A first object of the present invention to provide a method for desizing and/or shrinking a textile fabric. A second object of the present invention is an apparatus suitable for use for desizing and/shrinking a textile fabric. A third object of the invention is another apparatus suitable for treating a textile fabric, and said third object can be a part of the second object of the invention.

In the context of the present invention, apparatus can be considered as meaning a system or a machine. Each of the method and the machine of the first two objects of the invention solve the technical problem of how to perform desizing and/or shrinking of the fabrics in a more environmentally friendly and cost effective way without using excessive amounts of solvents, water and/or any other liquid or solid chemicals. Likewise, each of the first two objects of the present invention provide a solution to the problem of how to achieve desizing and/or shrinking of the textile fabric in a controlled and reliable manner. Moreover, the first two objects of the present invention allow for increasing the throughput of the textile processing, with the material being processed undergoing efficient desizing and/or shrinking. By means of the first two objects of the present invention a high degree of shrinkage and/or desizing of the textile material (fabric) can be achieved even when the textile fabric is processed at high speeds i.e. when the material is moving lengthwise at high speeds through the apparatus used for desizing and/or shrinking it.

For achieving the above, in its first aspect the present invention concerns a method for desizing and/or shrinking a textile fabric, the textile fabric having a length and a width, the method comprising moving lengthwise the fabric, and:

- wetting the fabric within a first pool of liquid, the first pool of liquid comprising water;
- passing the fabric through a chamber, and in said chamber contacting the fabric with at least one heatable roller heated at a treatment temperature;
- soaking the fabric with a main pool of liquid, the main pool of liquid comprising water;
- treating the fabric by means of ozone.

Preferably said ozone is in gas i.e. not in liquid, in which case the aforementioned last step of the method would be treating the fabric with (using/by means of) ozone in gas.

Optionally and preferably said treatment temperature is of between 80° C. and 160° C.

The first step of wetting the fabric with the first pool of liquid is important because it essentially prepares the fabric for the subsequent second step of passing the fabric though the chamber wherein essentially a heat treatment of the fabric occurs, at least due to the heated roller with which the fabric contacts. It is very preferable and advantageous that the fabric enters being wet in said chamber so that in said chamber at least some of the liquid absorbed on the fabric as a result of the first step, is being evaporated, and said evaporation is a preferable and advantageous technical effect related to the desired end result of the method. Consequently, optionally and preferably, wetting the fabric with the first pool of liquid comprises inducing (achieving) a wet pickup (pick-up) value of more than 50%. Therefore, optionally and preferably said wetting the fabric with the first pool of liquid comprises obtaining a wet pickup value of more than 50%. If the fabric enters said chamber having a wet pick-up (pickup) value of less than 50%, then the subsequent heat processing of the fabric happening in the chamber may potentially result to suboptimum desizing and/shrinking of the fabric. The wet pickup value is a figure of magnitude well known in the art, and is generally defined as: (weight of the liquid absorbed on the textile material)/(weight of the textile material when dry)*100 (%), wherein both of the aforementioned weights are measured in same weight units. Therefore, in an example a wet pickup value of 50% signifies that every 10 kg of textile material (when said textile material is dry) have absorbed 5 kg of liquid.

Another technical effect of the first step of wetting the fabric within the first pool of liquid, is that wetting of the fabric may directly initiate and/or cause some (but not all) shrinkage and/or desizing of the fabric. For example, at least some of the size material of a warp yarn of a fabric may dissolve in the liquid of said first pool of liquid. Consequently, controlling the temperature of said first pool of liquid, and preferably heating said first pool of liquid, can result to optimizing the achieved overall desizing and/or shrinking. Therefore, in the method of the first aspect of the invention, optionally and preferably the first pool of liquid has a temperature of between 10° C. and 100° C., and preferably of between 60° C. and 100° C. Generally, the regulation of the temperature of said first liquid aims towards improving any of the following: i) the absorption of the liquid by the fabric, ii) the potential dissolution of the size material, iii) the start of the shrinkage of the fabric.

Shrinking and/or desizing the fabric may further be optimized by adjusting the pH of the first pool of liquid and/or the pH of the main pool of liquid, and/or of any of the pools of liquids contained in the second module when the latter is operated, said second module mentioned further below. Adjusting the pH of any or both of said pools, and for example adjusting the pH of the first pool of liquid, may optionally be performed by adding to the respective liquid appropriate amounts of chemicals (chemical agents, bases and/or acids) and and/or measuring or probing the pH value with pH probes as is known in the art. In the present invention, optionally and preferably the first pool of liquid has a pH of between 4 and 12, and more preferably of between 7 and 11. The removal of the size material from the fabric's yarn(s) is favored when the pH has a value that is within one of the aforementioned ranges, and the inventors have noticed that this is true for several different size materials, as is evident by table 1 provided and described further below.

In the method of the first aspect of the invention optionally and preferably wetting the fabric with the first pool of liquid comprises contacting the fabric with a rotatable washing drum positioned in a tank containing said first pool, the rotatable washing drum being configured so that when it rotates it agitates said first pool of liquid and contacts and guides the fabric to enter and exit said first pool of liquid as the fabric moves lengthwise, and with said rotatable washing drum guiding the fabric to enter and exit the first pool of liquid.

Optionally and preferably in the method of the first aspect of the invention, passing the fabric through the chamber comprises moving the fabric lengthwise at a travel speed of between 1 m/min and 200 m/min, and preferably of between 5 m/min and 140 m/min. The travel speed is also called production speed. Setting the travel speed to be within the aforementioned ranges has the technical effect of achieving a good throughput during processing, wherein said throughput matches the throughput of other commonly applied processes in the textile industry such as dyeing of the fabric. Therefore, when the linear speed is set as indicated above, the method can be applied in line with other important processes without necessarily in between the processes having to stop the movement of the textile fabric. Moreover, said setting of the speed can allow for controlling the time the textile fabric and/or a treated lengthwise segment of said fabric, spends/passes in the chamber. Since the fabric preferably enters being wet the chamber, and therein can be heated by the heatable roller, at least some of the liquid on the fabric will be evaporated within said chamber, and this process may result to having within said chamber a high humidity. Therefore, within said chamber the fabric may be subject to a humid and hot environment which affects and promotes the desizing and/or shrinking of the fabric. Consequently, the time the fabric spends within said chamber is a parameter that is preferably controlled for optimizing the overall method. Therefore, in the method of the first aspect of the invention optionally and preferably passing the fabric through the chamber comprises having the fabric in said chamber for a total duration of between 0.1 minutes and 10 minutes, and preferably of between 0.15 minutes and 4 minutes.

Optionally and preferably the treatment temperature is of between 80° C. and 160° C. because at this temperature range a very high degree of desizing and/or shrinking effect is achieved. When said temperature is lower than 80° C. then the achieved effect may not be as prominent as desired, and if the temperature is more than 160° C. then there may occurs an excessive desizing and/or shrinking of the fabric and/or there may appear inhomogeneities and/or damages on the fabric. Optionally and preferably there is a plurality of heatable rollers in the chamber, each of said rollers being heated and coming into contact with the fabric thusly heating the latter.

Optionally and preferably said heatable roller(s) is (are) heated at said treatment temperature by means of vapor or steam that preferably is being introduced to the interior of the heatable roller(s). Therefore, the method of the first aspect of the invention may comprise heating said heatable roller(s) by means of vapor and/or steam, particularly steam. Optionally and preferably said vapor and/or steam is under a pressure. Optionally and preferably said pressure is of between 2 bars and 5 bars more preferably of between 2 bars and 4 bars. Usually, but not necessarily, when the heatable roller is heated by means of steam supplied to said roller, and in particular to an interior space/opening within said heatable roller, and the steam has (is under) a pressure of between 2 bars and 5 bars, then the treatment temperature is of between 80° C. and 160° C.

Optionally and preferably the heatable rollers are cylindrical or have a cylindrical shape. The heatable rollers optionally and preferably are heated at treatment temperature that is high, e.g. the treatment temperature is about 150° C., to produce a "thermal shock" in the highly moistened fabric with some potential objectives being: to facilitate shrinkage, to remove size material from the fabric (when there is size material), to facilitate the transfer of said size material from the fabric to the water/liquid, to prepare the fabric for the subsequent ozone treatment.

In the method of the first aspect of the invention optionally and preferably soaking the fabric with the main pool of liquid comprises:

- guiding the fabric to move from an entrance part to an exit part while successively (the fabric) entering and exiting multiple times the main pool of liquid, the latter extending from said entrance part to said exit part, and/or
- inducing a flow of the liquid from said exit part towards said entrance part.

Optionally and preferably said inducing a flow of the liquid from the exit part towards the entrance part, is achieved by having said main pool of liquid in a main tank, and in/at the latter having a liquid inlet located at or proximally to the exit part, and a liquid outlet located at or proximally to the entrance part and close to or about a top surface of the main pool of liquid, and by supplying via the liquid inlet liquid, causing that some of the liquid of the main pool of liquid exits the main tank via said liquid outlet. Optionally and preferably with respect to the ground on which the main tank resides, the liquid inlet is higher compared to the liquid outlet. Optionally, any, and preferably all of said main tank, liquid outlet and liquid inlet, and/or the aforementioned optional configuration (locations) of said liquid inlet and/or liquid outlet, can be features of the third module mentioned further below in relation to the second and/or third aspect(s) of the invention.

In the aforementioned optional case, guiding the fabric so that the latter enters and exits multiple times the main pool of liquid resembles passing the fabric through several baths, and therefore improves the removal of size material from the fabric and also improves the cleaning and shrinking of the fabric. Moreover, during the aforementioned movement of the fabric, the latter is expected to potentially leave more size material and/or residues (e.g. fibers, dye molecules, detergent molecules etc.) closer to the entrance part than closer to the exit part in the main pool of liquid. Therefore, as the fabric moves progressively from said entrance part to said exit part it may actually move from a dirtier part of the main pool to a cleaner part of the main pool, and this can be beneficial for the actual cleaning of the fiber. This in turn can be beneficial for optimizing the effect from the subsequent exposure of the fabric to the ozone or ozone gas, because a cleaner fabric surface is more highly and more homogeneously exposed to said ozone or ozone gas. Therefore, inducing a flow of the liquid from said exit part towards said entrance part can improve the aforementioned progressive cleaning of the fabric during the latter's successive dips within the main pool of liquid. Likewise, said flow can be an aspect of an optional recycling/recirculation of the liquid/water used.

In a similar way to what is explained above regarding the first pool of liquid, in the method of the first aspect of the invention optionally and preferably the main pool of liquid has a temperature of between 10° C. and 100° C., and preferably of between 60° C. and 100° C. Likewise, optionally and preferably the method comprises regulating the pH of the main pool of liquid.

Treating the fabric with ozone is another important step of the method. The ozone may preferably be ozone gas. Ozone is a strong oxidant under the action of which the overall desizing and/or shrinking of the fabric can be maximized to reach desired levels. In particular, the combination of the heat treatment in the aforementioned chamber and the ozone treatment, can result to desizing and/shrinking of a degree not achievable by the application of any of the individual steps alone. A preferable optional way for executing said treating of the fabric with ozone, is to use ozone gas and wet the fabric just before exposing it in an ozone-rich gaseous atmosphere, then execute said exposing of the fabric to ozone gas, and after said exposing to further wet the fabric for cleaning it and for removing ozone and/or other residues from the surface of the fabric. Therefore, in the method of the first aspect of the invention, optionally and preferably treating the fabric with ozone is treating the fabric by means of ozone in gas and comprises:

passing the fabric through a pre-treatment tank containing water;

squeezing out water from the fabric;

lengthwise moving the fabric through an ozone treatment hollow chamber that comprises rollers for directing the movement of the fabric and contains ozone in gas, the ozone treatment hollow chamber being configured so that the fabric moves within the chamber along a linear path;

passing the fabric through a post-treatment tank containing water.

Optionally and preferably said squeezing out water from the fabric is adjusted for, or comprises, achieving a final wet pickup value of between 20% and 90%, because the fabric preferably must be wet containing a controlled amount of water for achieving a uniform and pronounced ozone induced effect on the desizing and/or shrinking of the fabric. Said squeezing optionally and preferably is done using a Foulard type roller, so that the specific processing step is done easily and in a well-controlled way.

Likewise, said lengthwise moving of the fabric is optionally and preferably done at a linear speed of between 1 m/min and 200 m/min, because when the fabric moves too slow, and for example at a speed that is less than 1 m/min, inhomogeneities and defects (e.g. spots) may appear on the fabric due to an excessive treatment by ozone, and when the fabric moves too fast via the chamber, and for example moves at speeds higher than 200 m/min, then the fabric may potentially have to be stopped before optionally undergoing further processing after the method of the present invention. More preferably, the speed with which the fabric moves through the ozone containing chamber is of between 5 m/min and 140 m/min. Likewise, optionally and preferably said linear path has a length of between 5 m and 120 m, and this essentially can be interpreted as meaning that the hollow chamber is configured so that (i.e. for setting that) the linear path has a length of between 5 m and 120 m. The aforementioned preferred range of the optional linear path length values allows for allowing achieving a high throughput. Likewise, it allows for allowing the fabric to spent sufficient time in the hollow chamber so that a sufficient amount of ozone impinges on the fabric during the passage of the latter though the hollow chamber.

Optionally and preferably the ozone is in gas (i.e. not in liquid) and the concentration of ozone in gas is of between 2 g/Nm$^3$ and 150 g/Nm$^3$, because within said values the ozone is sufficiently high as to induce a noticeable and optimized contribution to the desizing and/or shrinking of the fabric, and at the same time the ozone concentration is not too high and does not cause undesired effects such as for example excessive bleaching.

Optionally and preferably the method is executed by a means of a first module, a second module, a third module and a fourth module. Accordingly, a preferred embodiment of the first aspect of the invention is a method for desizing and/or shrinking a textile fabric, the textile fabric having a length and a width, the method comprising moving lengthwise the fabric successively passing it through a first module that is configured for wetting the fabric with a first pool of liquid contained thereat, a second module that is configured for heating the fabric with at least one heatable roller that is thereat and is heated at a treatment temperature that preferably is of between 80° C. and 160° C., a third module that is configured for soaking the fabric with a main pool of liquid contained thereat, and a forth module that is configured for treating the fabric with ozone gas, wherein:

in the first module wetting the fabric with the first pool of liquid, the first pool of liquid comprising water;

in the second module contacting the fabric with the at least one heatable roller;

in the third module soaking the fabric with the main pool of liquid, the main pool of liquid comprising water;

in the fourth module treating the fabric with ozone in an ozone treatment hollow chamber. Preferably said ozone treatment hollow chamber is filled with a gas.

The invention in its second aspect concerns an apparatus for desizing and/or shrinking a textile fabric, the textile fabric having a length and a width, the apparatus comprising a first module that is configured for containing a first pool of liquid comprising water for wetting the fabric when the apparatus is operated, a second module that comprises at least one heatable roller and is configured for heating said at least one heatable roller at a treatment temperature and for heating the fabric via contacting the latter with said at least one heatable roller when the apparatus is operated, a third module that is configured for containing a main pool of liquid comprising water for soaking the fabric thereat when the apparatus is operated, and a fourth module that is configured for treating the fabric with ozone when the apparatus is operated, the apparatus being configured for moving lengthwise the fabric successively passing it through the first module, the second module, the third module, and the fourth module when the apparatus is operated. Optionally and preferably said treatment temperature is of between 80° C. and 160° C. Also, preferably the fourth module is configured for treating the textile with ozone gas when the apparatus is operated, i.e. the ozone is ozone gas.

Preferably and optionally the second module comprises a chamber wherein there may be said at least one heatable roller. The at least one heatable roller may be arranged at said optional chamber of the second module.

The apparatus is suitable for executing the method of the first aspect of the invention.

The first module is also called the wetting module.

The second module is also called the heating module.

The third module is also called the soaking module.

The fourth module is also called the ozone module.

In the described further below optional case that the first module is integrated with the second module and in particular with the second module's entrance, then said second module that essentially comprises the elements of the first module (i.e. the second module includes the first module) is also called the wetting and heating module.

Optionally and preferably the apparatus contains at least one traction roller that is configured for moving lengthwise the fabric. Preferably the apparatus comprises more than one traction rollers. A non-binding example of a type of roller than may act as traction roller is Foulard type roller, nevertheless other types of known roller types can be optionally used for inducing said movement of the fabric when the apparatus is operated.

Any of the apparatus' rollers and/or chambers and or any other parts that are part of the path followed by the fabric moving through the apparatus is optionally and preferably configured so that the fabric is fully extended widthwise as it passes though the apparatus. Therefore, optionally and preferably the length of any, and preferably all of the rollers, such as the heatable roller, any of the modules, and of the pools within said modules and/or optional tanks at said modules, such as the first tank mentioned below, the optional rotatable washing drum mentioned below, the chamber, and optional hollow chamber mentioned below, is equal or larger than the width of the fabric.

Optionally the heatable roller is heatable (or heated) by hot liquid supplied to the interior of the roller when the apparatus is operated, and in this case the roller is heated at the aforementioned temperature by said liquid that preferably has the same or a similar (close) or a higher temperature. Likewise, optionally the apparatus comprises heaters for heating said heatable roller and/or for heating the optional liquid optionally supplied to the interior of the heatable roller. Optionally and preferably when the apparatus is operated the heatable roller is heated by hot liquid and/or vapor and/or steam supplied the interior of the roller i.e. inside said heatable roller(s). Therefore, optionally and preferably the apparatus comprises vapor supply means and/or steam supply means configured to supply vapor and/or steam to the interior of (i.e. inside) said heatable roller(s) when the apparatus is operated. Optionally said steam and/or vapor has a pressure of between 2 bars and 5 bars. Optionally and preferably the second module comprises at least one motor that is connected to and/or configured to drive/rotate said at least one heatable roller. In a specific non-limiting example, the second module comprises a plurality of heatable rollers and at least one motor configured to rotate at least two heatable rollers when the apparatus is operated.

Optionally and preferably the first, the second, the third and the fourth module are (correspondingly) successively positioned and in the same order across the length of the apparatus. Optionally and preferably the first and the second module are physically connected or attached to each other, so that the apparatus is compact. Likewise, optionally and preferably the third module is connected or attached to the second module. Optionally and preferably the fourth module is connected or attached to the third module.

In the apparatus according to the first aspect of the invention optionally and preferably the first module comprises a first tank that is configured to contain the first pool of liquid when the apparatus is operated, and the first module also comprises a rotatable washing drum positioned in said first tank and is configured to agitate said first pool of liquid when the apparatus is operated, and is also configured to contact and guide the fabric so the latter enters and exits said first pool of liquid when the apparatus is operated.

The rotatable drum can act as a roller on which the moving fabric conforms when the apparatus is operated. Optionally the rotatable drum has perforations, so that said perforations induce or promote the aforementioned agitation of the first pool of liquid. Likewise, optionally and preferably the rotatable drum is positioned (i.e. it is configured) so that it is partially or fully immersed in said first pool of liquid. The tank optionally contains a liquid inlet and/or a liquid outlet via which water (liquid) can be introduced in and/or be removed from said tank. Likewise, any of the apparatus' other tanks or components configured for containing pools of liquids may optionally contain respective inlets and/or outlets. Optionally and preferably the rotatable drum, and/or indeed any roller of the apparatus such the at least one heatable roller, is connected to a motor that is configured for moving/rotating said drum and/or roller when the apparatus is operated.

Optionally and preferably in the apparatus according to the first aspect of the invention, the second module comprises a chamber that has a second module entrance with an entrance tank thereat that is configured to contain an entrance pool of liquid when the apparatus is operated, a second module exit with an exit tank thereat that is configured to contain an exit pool of liquid when the apparatus is operated, and/or a heatable ceiling, and/or a plurality of heatable rollers within said chamber.

Said optional heatable ceiling, meaning the top surface of the interior of the chamber, when heated prevents the formation of droplets thereat, and this is beneficial for the uniform treatment of the fabric because if said drops are formed and fall on the passing (moving) fabric, then the heat treatment of the fabric, and the final effect on the appearance or mechanical properties of the fabric, may not be as homogenous and optimum as desired. Therefore, optionally and preferably the apparatus comprises heaters that are attached/or adjacent to said heatable sealing and configured to heat the latter when the apparatus is operated.

Optionally and preferably each of said heatable rollers is configured to be heated at the treatment temperature. Optionally and preferably the second module comprises temperature control means for measuring and/or controlling the aforementioned treatment temperature. Optionally said temperature control means may be or comprise a temperature sensor and/or a temperature controller. A temperature sensor may optionally be attached to a heatable roller or to a heating medium or element which may contribute to heating said heatable roller. Likewise, optionally the second module may be pre-configured for heating said at least one heatable roller at the treatment temperature when the second module is operated, without the need for actively or continuously measuring or controlling the treatment temperature during the operation of the second module or during the operation of the overall apparatus.

Optionally and preferably, the heatable rollers are rotatable and are preferably configured to guide (i.e. direct/conduct) the fabric so that the latter successively contacts (i.e. can/will contact) each of said heatable rollers and moves (i.e. can/will move) from the second module entrance towards the second module exit when the apparatus is operated. In this manner the fabric can travel smoothly through the module, the uniformity of the heat treatment across the fabric is improved, and the number of the rollers can be adjusted to adjust the duration of the total time the fabric is in contact with a surface of a desired high or maximum temperature. Optionally and preferably the number of heatable rollers in the chamber is of between two and twenty-four, and more preferably is four or eight or sixteen or twenty-four.

Optionally and preferably the second module entrance is configured to allow the fabric to enter into the chamber via passing through said second module entrance and through the entrance pool of liquid thereat when the apparatus is operated. In the entrance pool of liquid the fabric can be wet for ensuring that being wet it enters a hot zone of the chamber, because this is desired as explained further above.

Optionally and preferably the second module exit is configured to allow the fabric to exit from the chamber via passing through said second module exit and through the exit pool of liquid when the apparatus is operated. In the exit pool the fabric can be wet by the liquid thereat, so that in said exit pool in principle at least some of the size material and/or any residue materials or dirt potentially present on the fabric can be at least partially washed away.

Optionally and preferably the second module entrance is configured to prevent air from passing through the second module entrance (and) from inside the chamber to outside the chamber without said air passing through the entrance pool of liquid when the apparatus is operated. Likewise, optionally and preferably the second module exit is configured to prevent air from passing through the second module exit (and) from inside the chamber to outside of it without said air passing through the exit pool of liquid when the apparatus is operated. Therefore, the second module exit and the second module entrance, and the respective tanks and liquid pools thereat when the apparatus/module is operated, serve the purpose of acting as liquid barriers inhibiting the direct contact between the atmosphere inside the chamber and the atmosphere outside of it, so that it is easier to control the conditions, and especially the temperature and humidity, inside the chamber.

For improving the compactness and energy efficiency of the apparatus, optionally and preferably the first module is integrated with the second module entrance and the first pool of liquid is the entrance pool of liquid. In this optional case, essentially the second module entrance tank is (acts as) the first tank (of said first module). Likewise, the aforementioned optional rotatable drum can optionally be in/at the aforementioned second module entrance tank, and can optionally be configured to agitate said entrance pool of liquid.

In the apparatus according to the second aspect of the invention, optionally and preferably the third module comprises a plurality of guiding rollers, an entrance part, an exit part, the main pool of liquid extending from said entrance part to said exit part, wherein the plurality of guiding rollers are configured to guide (direct/conduct) the fabric so that the latter moves from the entrance part to the exit part while successively entering and exiting multiple times the main pool of liquid when the apparatus is operated. In the aforementioned optional case, further optionally and preferably the apparatus comprises liquid flow means which are configured to induce a flow of the liquid within the main pool of liquid from the exit part towards the entrance part when the apparatus is operated. Optionally, said liquid flow means force the liquid to flow from the exit part towards the entrance part.

Said liquid flow means result to achieving a stream of liquid within said main pool of liquid, meaning creating/having a stream of liquid within at least a main tank containing said main pool of liquid when the apparatus is operated. The liquid flow means optionally comprise a pump, e.g. a sanction pump, and/or a recirculation system that is configured to inject on at least one side, and preferably at the aforementioned exit part, said liquid towards the entrance part. Said optional recirculation system, which preferably comprises a tubing system connected to said main pool of liquid, i.e. to a main tank containing said main pool of liquid, optionally and preferably has a recirculation inlet located at said entrance part and a recirculation outlet located at said exit part, and is further preferably configured to take via said recirculation inlet liquid from the entrance part, and to provide via said recirculation outlet liquid at said exit part. The optional recirculation system optionally and preferably comprises a water cleaning system that may comprise at least one filter and is configured to at least partially clean the liquid e.g. at least partially clean the water by removing or eliminating or neutralizing fibers and/or chemicals etc. The recirculation system may optionally be connected to any of the first, the second the third and the fourth module of the system, for providing liquid thereat.

In the apparatus according to the second aspect of the invention, optionally and preferably the fourth module comprises a pre-treatment tank that is configured to contain water and is configured for the fabric passing through, (the fabric) being wetted at, said pre-treatment tank when the apparatus is operated. Accordingly, preferably the pre-treatment tank has a size, such as a width, that is adapted so that the fabric can lengthwise pass (travel, move) through said pre-treatment tank, (the fabric) being widthwise (fully) extended/spread. Optionally and preferably the same applies regarding the post-ozone treatment tank and/or the hollow chamber and/or the Foulard-type roller mentioned further below.

Optionally and preferably the fourth module comprises a Foulard type roller configured for receiving the fabric from the pre-treatment tank and for squeezing out water from the fabric to a wet pickup value (i.e. so that the fabric upon exiting/leaving said Foulard type roller has a wet pickup value) that further preferably/optionally is of between 20% and 90%, when the apparatus is operated. An optional way via which said wet pickup value can be achieved comprises adjusting how much the Foulard type roller can press/squeeze the fabric. In an optional case wherein the Foulard type roller comprises two sub-rollers squeezing from both sides the fabric, the distance between said sub-rollers can be adjusted so that the wet pickup value of the fabric, upon the latter leaving/exiting said Foulard type roller, is adjusted.

Optionally and preferably the fourth module comprises an ozone treatment hollow chamber adjacent to the pre-treatment tank, wherein the ozone treatment hollow chamber comprises rollers and the apparatus when operated is configured for lengthwise moving through the ozone treatment hollow chamber the fabric when the latter exits (leaves) the pre-treatment tank and/or the Foulard type roller. Optionally and preferably said ozone treatment hollow chamber comprises said optional Foulard type roller, i.e. the Foulard type roller is inside said hollow chamber, and more preferably the Foulard type roller is above said pre-treatment tank and/or adapted or positioned (or the apparatus as a whole is adapted) so that the fabric exiting the pre-treatment tank passes through said Foulard type roller before travelling through further inside the hollow chamber. Therefore, preferably said optional Foulard type roller is within a hollow chamber's part/side that is proximal to said pre-treatment tank.

Optionally and preferably the apparatus when operated is configured for lengthwise moving through the ozone treatment hollow chamber the fabric, preferably at a (linear) speed of between 1 m/min and 200 m/min, more preferably of between 5 m/min and 140 m/min. For this purpose, optionally and preferably the apparatus and/or said fourth module comprises traction rollers which are configured to move lengthwise the fabric. The aforementioned Foulard type roller, can act to do/drive said lengthwise movement of the fabric. Likewise, the fourth module may comprise a second Foulard type roller installed (located) at or above the mentioned further below post-ozone treatment tank, and preferably located outside said ozone treatment chamber.

The aforementioned rollers are preferably configured for directing the movement of the fabric through the hollow chamber when the apparatus is operated. Optionally and preferably the rollers are configured to guide the fabric so that the latter successively moves upwards and downwards within the ozone treatment hollow chamber when the apparatus is operated.

Preferably the apparatus and/or the fourth module comprise/s an ozone supply system for supplying ozone or ozone gas or an ozone containing composition to the fourth module or to the ozone treatment hollow chamber. In a non-limiting example, said ozone supply system may comprise an ozone generator, such as for example an ozone gas generator. Said optional ozone generator may be for generating ozone gas, and the ozone supply system may further comprise tubes connected to the ozone generator and to inlets or nozzles which may located at the ozone treatment hollow chamber for delivering to the latter ozone gas. Said ozone containing composition may optionally be a mixture of gases, or a liquid with ozone diluted therein, or a liquid-gas mixture, or a spray. Optionally in said ozone containing composition the ozone may be ozone gas.

Preferably the apparatus and/or the fourth module comprise/s an ozone generator configured to generate and provide to the ozone treatment hollow chamber ozone.

Most preferably said ozone generator is configured to provide to said ozone treatment hollow chamber ozone at a concentration in gas that preferably is of between 2 g/Nm$^3$ and 150 g/Nm$^3$ when the apparatus is operated.

Optionally and preferably the apparatus and/or the fourth module is further configured to move the fabric through the ozone treatment hollow chamber along a linear path of a length that preferably is of between 5 m and 120 m when the apparatus is operated.

Optionally and preferably the fourth module comprises a post-ozone treatment tank that is configured to contain water for wetting the fabric when the apparatus is operated, and is configured for receiving the fabric from the ozone treatment hollow chamber when the apparatus is operated. In said optional post-ozone treatment tank the fabric is further cleaned, e.g. ozone molecules and/or other residues and/or fibers and/or size material and/or dye molecules can be removed by the liquid/water in said optional post-ozone treatment tank, when the apparatus is operated.

The liquid in each of the aforementioned optional and preferable post-ozone treatment tank and pre-treatment tank when the latter two contain said liquid serves the purpose of preventing ozone gas from directly escaping from the interior of the chamber to the atmosphere outside the fourth module when the system is operated. Therefore, in each tank said liquid acts as a liquid barrier that prevents the uncontrolled escape of ozone from the hollow chamber. Accordingly, it is obvious that said preventing occurs when each of the tanks is filled with said liquid up to a required level.

The apparatus according to the second aspect of the invention, and preferably each or any one of the first module, the second module, the third module and the fourth module, comprises at least one tension compensator that is in contact with the fabric and configured to control the lengthwise tension of the fabric preferably by adjusting a lengthwise speed of the fabric as the latter moves through the apparatus when the latter is operated. Likewise, a tension compensator may optionally be located in between two successive modules. The desizing and/or shrinking of the fabric are interlinked with and may affect the mechanical properties of the fabric, and the inventors report that by controlling the mechanical state of the fabric during desizing and/or shrinking said fabric, particularly by keeping said fabric in a controlled tensed state when heating the fabric in the second module and/or treating the fabric with ozone in the fourth module, then said desizing and/shrinking can be further optimized avoiding the formation of defects (e.g. spots or inhomegenities) across the length and/or width of the fabric. Consequently, optionally and preferably the second module comprises a tension compensator that more preferably is within the chamber. Likewise, optionally and preferably the fourth module comprises a tension compensator, more preferably said tension compensator being within the ozone treatment hollow chamber. Likewise, optionally and preferably there is a tension compensator in between the second and the fourth module.

Optionally and preferably the apparatus of the second aspect of the invention comprises a liquid circulation system that (inter)connects between them any, and preferably all, of the aforementioned liquid fillable tanks of the apparatus' modules, so that liquid or water is passed from one module and/or tank to the next one. Said liquid circulation system, which preferably comprises a pump (e.g. circulation pump) for liquid circulation/movement, is preferably configured for moving liquid from the fourth module to (towards) the third module and/or to the second and/or to first module, and/or from the third module to the second module and/or to the first module, and/or from the second module to the first module, and/or move liquid from the first module towards (to) any of the first, second or third module, and/or move liquid from the second module towards any of the third or fourth module, and/or move liquid from the third module towards the fourth module. Most preferably the liquid circulation system connects and moves/recirculates water between the first module, the second module and the third module.

The invention in its third aspect concerns an apparatus that comprises the first module, the second module and the third module of the apparatus according to the second aspect of the invention. Therefore, an apparatus that is according to the third aspect of the invention is a part of the apparatus of the second aspect of the invention, wherein said part does not comprise the fourth module, but may comprise any of the other elements and features of the apparatus of the second aspect of the invention. Accordingly, all the aforementioned optional and essential features of the apparatus of the second aspect of the invention, except the ones of the fourth module, can equally be considered as being corresponding features of an apparatus according to the third aspect of the invention. The apparatus of the third aspect of the invention is compact and can be used in combination with preexisting machines/installations that are used for treating textile fabrics with ozone gas. Therefore, the apparatus of the fourth aspect of the invention solves the problem of how to utilize said preexisting installations, in order to achieve desizing and/or shrinking of textile fabrics in an optimum way as mentioned above in relation to the first two aspects of the invention. In particular, the apparatus of the third aspect of the invention is compact, simple, easy to operate and install, helps to reduce the energy and water required for processing textile fabrics, and is versatile and compatible for use in conjunction with other apparatuses used for processing textile fabrics.

BRIEF DESCRIPTION OF DRAWINGS

The previous and other advantages and features will be more fully understood from the following detailed description of embodiments, with reference to the attached figures, which must be considered in an illustrative and non-limiting manner, in which.

DETAILED DESCRIPTION OF THE EMBODIMENTS

Figure 1:
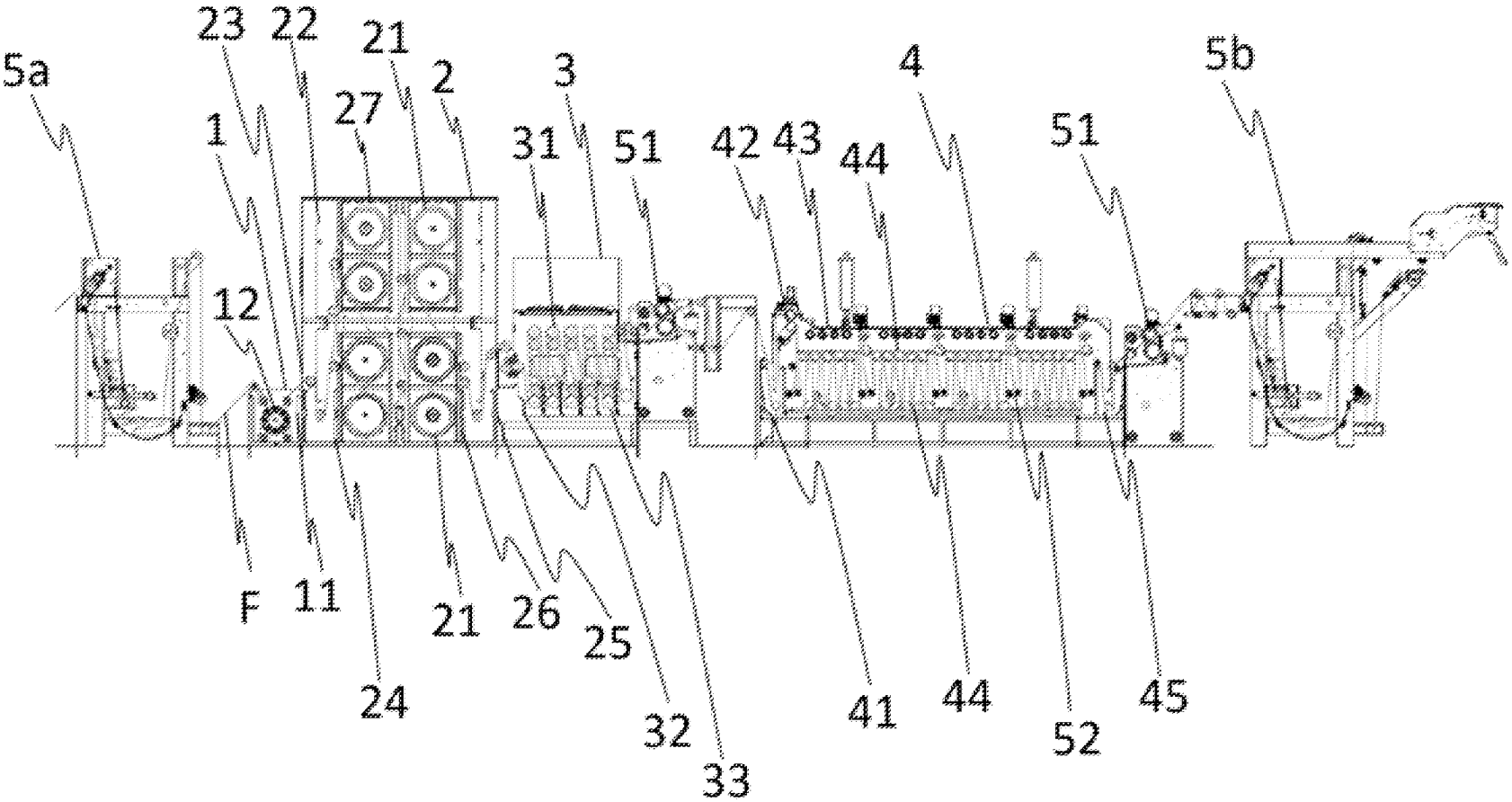
FIG. 1 is a schematic diagram of a preferred embodiment of an apparatus according to the second aspect of the invention.

FIG. 1 shows a schematic diagram, that is a cross section, of a preferred embodiment of an apparatus for desizing and/or shrinking a textile fabric, the textile fabric having a length and a width, the apparatus comprising a first module 1 that is configured for containing a first pool of liquid comprising water for wetting the fabric when the apparatus is operated, a second module 2 that that comprises a plurality of heatable rollers 21 and is configured for heating said plurality of heatable rollers 21 at a treatment temperature and for heating the fabric via contacting the latter with said at least one heatable rollers 21 when the apparatus is operated, a third module 3 that is configured for containing a main pool of liquid (not shown) comprising water for soaking the fabric thereat when the apparatus is operated, and a fourth module 4 that is configured for treating the fabric with ozone gas when the apparatus is operated, the apparatus being configured for moving lengthwise the fabric successively passing it through the first module 1, the second module 2, the third module 3, and the fourth module 4 when the apparatus is operated. In FIG. 1 there is also indicated the textile fabric that is lengthwise spread across the apparatus as is represented by the gray line grey line extending across the length of the apparatus going through the latter's various modules.

As is shown in FIG. 1 the first module 1 comprises a first tank 11 that is configured to contain the first pool of liquid when the apparatus is operated, and the first module 1 also comprises a rotatable washing drum 12 positioned in said first tank 11 and is configured to agitate said first pool of liquid when the apparatus is operated, and is also configured to contact and guide the fabric so the latter enters and exits said first pool of liquid when the apparatus is operated.

As is also shown in FIG. 1 the second module 2 comprises a chamber 22 that has a second module entrance 23 with an entrance tank 24 thereat that is configured to contain an entrance pool of liquid when the apparatus is operated,

- a second module exit 25 with an exit tank 26 thereat that is configured to contain an exit pool of liquid when the apparatus is operated,
- a heatable ceiling 27, and
- the plurality of heatable rollers 21 within said chamber 22, wherein
- each of said heatable rollers 21 is configured to be heated at the treatment temperature,
- the heatable rollers 21 are rotatable and are configured to guide the fabric so that the latter successively contacts each of said heatable rollers and moves from the second module entrance 23 towards the second module exit 25 when the apparatus is operated,
- the second module entrance 23 is configured to allow the fabric to enter into the chamber 22 via passing through said second module entrance 23 and through the entrance pool of liquid thereat when the apparatus is operated,
- the second module exit 25 is configured to allow the fabric to exit from the chamber 22 via passing through said second module exit 25 and through the exit pool of liquid when the apparatus is operated,
- the second module entrance 23 is configured to prevent air from passing through the second module entrance and from inside the chamber to outside of it without said air passing through the entrance pool of liquid when the apparatus is operated, the second module exit 25 is configured to prevent air from passing through the second module exit and from inside the chamber to outside of it without said air passing through the exit pool of liquid when the apparatus is operated.

More specifically FIG. 1 shows that in the specific embodiment the first module comprises eight heatable rollers 21.

In the embodiment shown in FIG. 1 the third module 3 comprises liquid flow means (not shown), a plurality of guiding rollers 31, an entrance part 32, an exit part 33, the main pool of liquid extending from said entrance part 32 to said exit part 33, wherein the plurality of guiding rollers are configured to guide the fabric to move from the entrance part 32 to the exit part 33 while successively entering and exiting multiple times the main pool of liquid when the apparatus is operated, and the liquid flow means are configured to induce a flow of the liquid within the main pool of liquid from the exit part 33 towards the entrance part 32 when the apparatus is operated.

Likewise, in the embodiment shown in FIG. 1 the fourth module 4 comprises:

a pre-treatment tank 41 that is configured to contain water and is configured for the fabric to pass through and be wetted at said pre-treatment tank when the apparatus is operated;

a Foulard type roller 42 configured for receiving the fabric from the pre-treatment tank 41 and for squeezing out water from the fabric when the apparatus is operated;

an ozone treatment hollow chamber 43 adjacent to the pre-treatment tank 41, wherein the ozone treatment hollow chamber 43 comprises rollers 44 and the apparatus when operated is configured for lengthwise moving through the ozone treatment hollow chamber the fabric when the latter exits the pre-treatment tank 41 and the Foulard type roller 42, the rollers 44 being configured for directing the movement of the fabric through the hollow chamber 43 when the apparatus is operated, and the apparatus comprises an ozone generator (not shown) configured to generate and provide to the ozone treatment hollow chamber 43 ozone at a concentration in gas, the apparatus being further configured when operated to move the fabric through the ozone treatment hollow chamber 43 along a linear path;

a post-ozone treatment tank 45 that is configured to contain water for wetting the fabric when the apparatus is operated, and is configured for receiving the fabric from the ozone treatment hollow chamber 43 when the apparatus is operated.

As indicated in FIG. 1 the specific embodiment, and specifically the fourth module, comprises at least one tension compensator 52 that is in contact with the fabric and configured to control (adjust, probe) the lengthwise tension of the fabric, and to preferably maintain said fabric tensed (lengthwise) when the apparatus is operated.

Also in FIG. 1 there is shown in the specific embodiment there are two J-boxes 5*a*, 5*b* on either sides of the shown apparatus; the J-boxes are optional components of the apparatus. The apparatus shown in FIG. 1 also comprises traction rollers 51.

Figure 2:
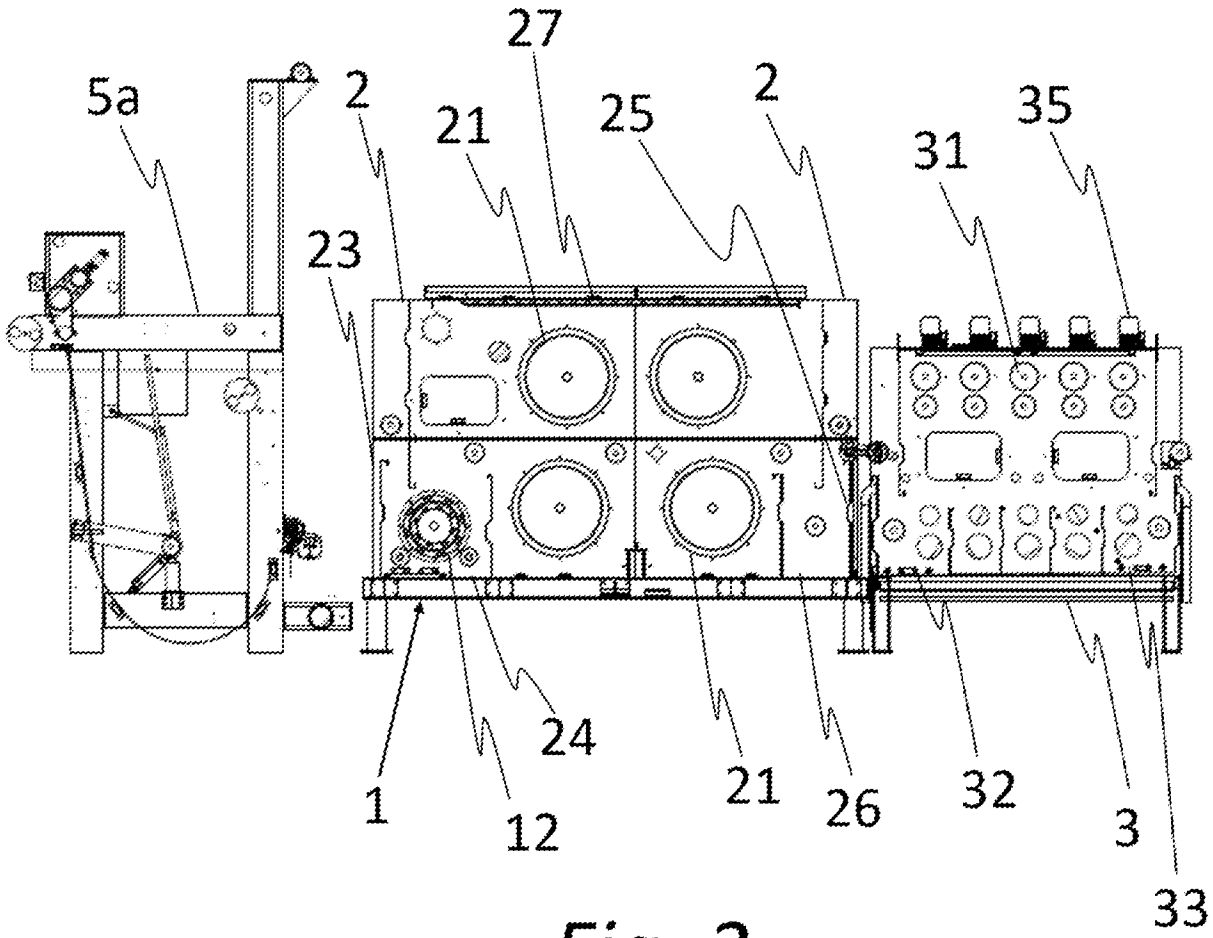
FIG. 2 is a schematic diagram of a part of another preferred embodiment of an apparatus according to the second aspect of the invention.

FIG. 2 shows the first, second and third module of another embodiment of an apparatus according to the second aspect of the invention, wherein the first module 1 is integrated with the second module entrance 23 and the first pool of liquid is the entrance pool of liquid. Therefore, in effect in the embodiment shown in FIG. 2 the second module's second tank is also the first module's first tank that was mentioned further above in relation to FIG. 1. As is also indicated in FIG. 2 the third module comprises drive motors 35 that are configured for rotating corresponding guiding rollers 31 of the apparatus; this does not signify that all guiding rollers 31 are necessarily connected to drive motors. FIG. 2 essentially also shows a preferred embodiment of an apparatus according to the third aspect of the invention. In the embodiment shown in FIG. 2, a rotatable washing drum 12 is in the entrance tank 24.

Figure 3:
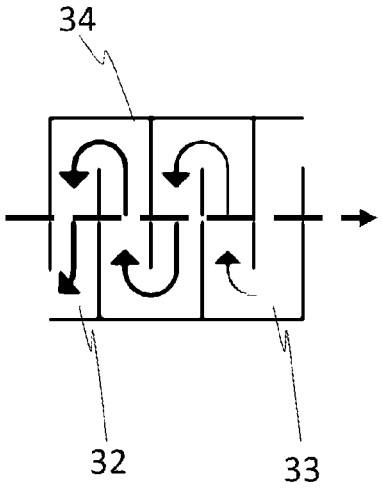
FIG. 3 is a schematic diagram of a top view of a part of an embodiment of an apparatus that is according to the second aspect of the invention.

FIG. 3 shows a top view of a the main pool of liquid in the third module of the apparatus of any of the embodiments shown in FIG. 1 and FIG. 2. Said main pool of liquid is contained in a main tank 34 of said third module, and said main pool of liquid extends from the entrance part 32 to the exit part 33. The main tank 34 is shaped (configured to) form a zig-zag shaped channel, wherein the main pool of liquid extends along said zig-zag shaped channel. The fabric progressively moves across the main pool of liquid along the direction indicated by the straight arrowed line, and as the fabric moves across the third module successively enters and exits said main pool of liquid. The third module comprises flow means (not shown) that cause the liquid/water within the main tank to flow along the direction indicated by the curved arrows in FIG. 3.

Figure 4:
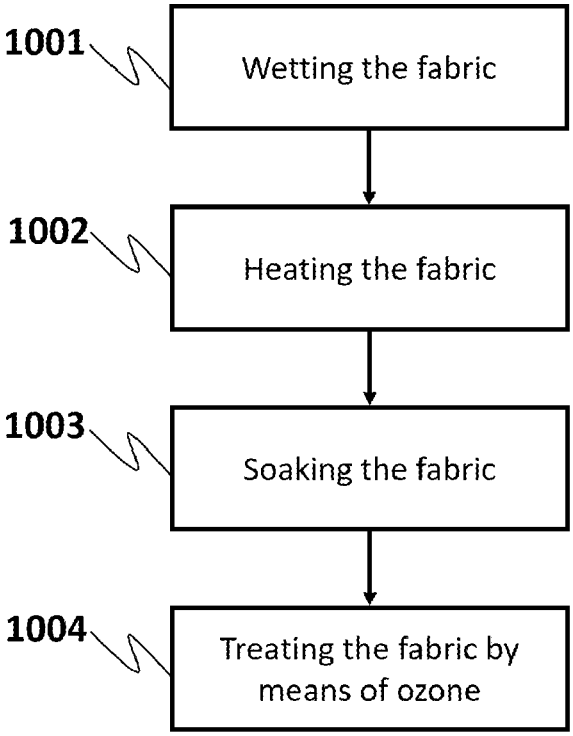
FIG. 4 is a flow diagram of an embodiment of a method according to the first aspect of the invention.

FIG. 4 is a flow diagram of a preferred embodiment of a method that is according to the first aspect of the invention. As indicated in FIG. 4 the method comprises successively performing the steps of wetting the fabric 1001, heating the fabric 1002, soaking the fabric 1003, treating the fabric by means of ozone 1004. Wetting and soaking are done utilizing water. Said treating with ozone is most preferably performed by exposing the fabric to a gaseous atmosphere that comprises ozone.

Figure 5:
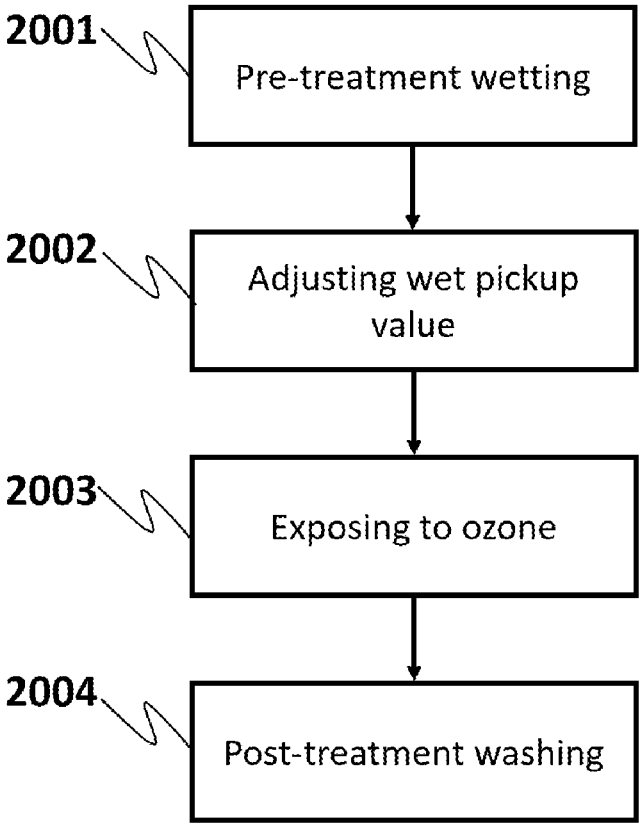
FIG. 5 is a flow diagram of a part of an embodiment of a method according to the first aspect of the invention.

FIG. 5 shows a flow diagram of some important steps of a preferred way of treating the fabric with ozone. As indicated in FIG. 5 said preferred way comprises executing successively the step of:

pre-treatment wetting (of) the fabric 2001, e.g. wet/rinse/soak the fabric with water (before exposing the fabric to ozone);

adjusting the wet pickup value 2002 of the fabric, e.g. controllably squeezing out water or the fabric and/or controllably drying the fabric;

exposing the fabric to ozone 2003, e.g. passing the fabric through a chamber that contains a gaseous atmosphere that comprises ozone gas;

post-treatment washing the fabric 2004, e.g. rinse/soak the fabric with water (after exposing the fabric to ozone).

The inventors have observed a beneficial effect on achieving good desizing by adding certain chemicals in the liquid used in the first step of the method i.e. in the liquid(s) used for wetting the fabric before heating it in the second step, said liquid(s) being or comprising water. Likewise, the inventors have noticed a beneficial effect on achieving good desizing by increasing the temperature of said liquid (increasing temperature relative to the temperature of the ambient environment) i.e. by heating the liquid. Accordingly, the following table 1 indicates some chemicals and/or temperatures that should preferably be used in/with the water used in the first step of the method for efficiently removing from the fabric the corresponding size material shown in the table's left column:

TABLE 1

| Size material | Favorable conditions in liquid wetting the fabric before heating the latter |
|---|---|
| Starch and derivatives | It is removed using amylase enzyme at 60° C. |
| Polyvinyl alcohol PVA | It is removed using detergent at 90-95° C., pH 7-9 to avoid coagulation. Soluble in water. |
| Polyvinyl acetate PVAC | It is removed using detergent at 98° C. and pH 10. Soluble in water. |
| Polyacrylate PAC | pH 9.5-10.5. Washing temperature 80-98° C. |
| Polyacrylate (ammonium salt) | It can be removed using using detergent and carbonate at 95-100° C. |
| Polyester PES | High pH with carbonate or soda can cause it to precipitate (and set). Wash at 80-98° C. |
| carboxymethyl cellulose CMC | It can be removed in alkaline medium and at 70-80° C. It is soluble in water |

The method and the apparatus are preferably used for treating denim, and more preferably for treating elastic denim.

When the water used in the method and apparatus is recycled/reused, e.g. when the apparatus comprises a water recirculation system, then this allows to have a water consumption of as low as 1 L/m of treated fabric.

The method of the first aspect of the invention works exceptionally well for (pre)shrinking fabrics. A preferred embodiment of the method of the first aspect of the invention implemented via a preferred embodiment of the apparatus of the second aspect of the invention allowed for processing a textile fabric with a water consumption of just 2 L/kg. According to experiments conducted by the inventors, shrinking has been achieved for several different textiles, some of which are the following with their composition respectively indicated:

Marvel: 75% CO/22% PES/3% EA;
Vogue: 97% CO/3% EA;
Stop: 98% CO/2% EA;
Nevada: 98% CO/2% EA;
Ranger: 100% CO, wherein CO means cotton, PES means polyester, and EA means elastane. For all of said materials treated using the present invention a significant dimension stability (shrinkage control) was achieved after washing at 60° C. This is evident from the following table 2 which shows the achieved shrinking for the case of the Marvel fabric (for all the aforementioned fabrics similar experimental results have been achieved) that is according to quality standards of the fabric; the shrinking was studied following the test method AATCC 135. For the Marvel fabric studied, the specifications regarding quality dimensional stability are that a warp-wise shrinking of −2%±1.5%, and a weft-wise shrinking of −8%±2% should be achieved so that any subsequent further significant shrinking of the fabric is avoided. Indeed, as shown in table 2 with the present invention the achieved shrinking values are within said specification values regarding the fabric's quality dimensional stability.

TABLE 2

| | | Original (cm) | | After wash (cm) | | After wash (%) | |
|---|---|---|---|---|---|---|---|
| Process | Width | Warp | Weft | Warp | Weft | Warp | Weft |
| Present invention | 150.4 | 35.0 | 35.0 | 33.8 | 31.7 | −3.43 | −9.43 |

The processed fabric complies with the quality requirements regarding elasticity. Experiments have shown that the fabric which was shrinked as described in relation to table 2, did not lose its elasticity. More specifically, in relation to the weft of the fabric, stretch tests have been performed and have shown that the processed fabric exhibits a stretch of 51.82%. Therefore, the present invention works exceptionally well with elastic fabrics, particularly elastic denim.

While the foregoing is directed to embodiments of the present invention, other and further embodiments of the invention may be devised without departing from the basic scope thereof.

The invention claimed is:

1. A method for desizing and/or shrinking a textile fabric, the textile fabric having a length and a width, the method comprising:

moving, lengthwise, the fabric, wetting the fabric within a first pool of liquid, the first pool of liquid comprising water;

passing the fabric through a chamber, and, in said chamber, contacting the fabric with at least one heatable roller heated at a treatment temperature of between 80° C. and 160° C.;

soaking the fabric with a main pool of liquid, the main pool of liquid comprising water; and treating the fabric with ozone in gas;

wherein treating the fabric with ozone in gas further comprises:

passing the fabric through a pre-treatment tank containing water;

squeezing out water from the fabric;

moving the fabric lengthwise through an ozone treatment hollow chamber, the ozone treatment hollow chamber comprising rollers for directing the movement of the fabric and containing ozone, the ozone treatment hollow chamber being configured so that the fabric moves within the chamber along a linear path; and passing the fabric through a post-treatment tank containing water.

2. The method according to claim 1, wherein the first pool of liquid has a pH of between 4 and 12.

3. The method according to claim 1, wherein the first pool of liquid has a temperature of between 10° C. and 100° C.

4. The method according to claim 1, wherein wetting the fabric with the first pool of liquid comprises inducing a wet pickup value of more than 50%.

5. The method according to claim 1, wherein wetting the fabric with the first pool of liquid comprises contacting the fabric with a rotatable washing drum positioned in a tank containing said first pool, the rotatable washing drum being configured so that when it rotates it agitates said first pool of liquid and contacts and guides the fabric so that the latter enters and exits said first pool of liquid as the fabric moves lengthwise, and with said rotatable washing drum guiding the fabric so that the latter enters and exits the first pool of liquid.

6. The method according to claim 1, wherein passing the fabric through the chamber comprises moving the fabric lengthwise at a production speed of between 1 m/min and 200 m/min.

7. The method according to claim 1, wherein passing the fabric through the chamber comprises having the fabric in said chamber for a total duration of between 0.1 minutes and 10 minutes.

8. The method according to claim 1, wherein soaking the fabric with the main pool of liquid comprises:

guiding the fabric so that the latter moves from an entrance part to an exit part while successively entering and exiting multiple times the main pool of liquid, the latter extending from said entrance part to said exit part, and inducing a flow of the liquid from said exit part towards said entrance part.

9. The method according to claim 1, wherein the water is squeezed out from the fabric to a final wet pickup value of between 20% and 90%;

the fabric is moved at a linear speed that is between 5 m/min and 140 m/min;

the ozone treatment hollow chamber contains ozone at a concentration in gas that is between 2 $g/Nm^3$ and 150 $g/Nm^3$;

the linear path has a length of between 5 m and 120 m.

* * * * *